United States Patent [19]

Adams

[11] 4,167,890

[45] Sep. 18, 1979

[54] DIRECT DRIVE TOGGLE ACTION

[76] Inventor: Gregory A. Adams, 10036 Peninsula Ave., Cupertino, Calif. 95014

[21] Appl. No.: 829,929

[22] Filed: Sep. 1, 1977

[51] Int. Cl.[2] ..... F41D 3/02

[52] U.S. Cl. ..... 89/189

[58] Field of Search ..... 89/168, 175, 176, 189, 89/190

[56] References Cited

U.S. PATENT DOCUMENTS 544,658 8/1895 Browning ..... 89/190

2,714,334 8/1955 Harvey ..... 89/190

*Primary Examiner*—Stephen C. Bentley

*Attorney, Agent, or Firm*—C. Michael Zimmerman

[57] ABSTRACT

A firearm has an automatic, beyond-center locking toggle action which drives the breach block mechanically. A slide actuator on the firearm responds to the gas pressure generated by the explosion of a cartridge by operating a cam action driver not only to break the lock of the toggle linkage, but also to drive such linkage with positive cam action to withdraw the breach block from the firearm chamber.

6 Claims, 6 Drawing Figures

DIRECT DRIVE TOGGLE ACTION

BACKGROUND OF THE INVENTION

The present invention relates to a beyond-center locking toggle mechanism for automatically operating the breach block of a firearm and, more particularly, to such a mechanism which is driven with a minimum of parts by positive mechanical action throughout its travel, despite the fact that its operation is initiated by the gas pressure associated with a fired projectile.

Numerous automatic breach block withdrawal actions have been designed for firearms, particularly for pistols, utilizing an over- or under-center locking toggle linkage connected to the breach block. Such beyond-center locking toggle linkages can provide positive locking of the breach block into position for firing, while allowing a relatively simple withdrawal thereof to permit ejection of a shell and loading of a new one. U.S. Pat. Nos. 2,069,432 and 3,783,739 issued respectively to Watanabe and Perrine, disclose actions of this type. Such locking toggle actions typically have drawbacks which have prevented toggle linkages from being adopted to any appreciable degree. For example, most present designs, including the Watanabe and Perrine designs, rely on the back pressure generated within the barrel of the firearm acting against the breach block to urge such breach block into a withdrawn position once the toggle lock is broken. This utilization of the back pressure reduces the momentum imparted to the bullet or other projectile being fired, thus reducing the range and effectiveness of the firearm. Moreover, such back pressure is caused by the gas products resulting from the explosion of powder, which gas products flow into the breach operating mechanism if the pressure of the same is used to move the breach block. These products will build up over a period of time within the breach block operating mechanism and other movable parts of the firearm, causing malfunctions.

SUMMARY OF THE INVENTION

The present invention relates to a beyond-center locking toggle firearm action which does not have the above disadvantages. More particularly, it comprises combining with a toggle linkage connected to the breach block to lock the same into position closing the firearm chamber, a cam action driver for the linkage which is responsive to the firing of a projectile by not only breaking the toggle lock, but also driving the toggle with positive camming action to withdraw the block from the chamber. It provides such positive drive by utilizing for motive force that portion of the kinetic energy of the gas pressure generated on firing the firearm which otherwise would be wasted. Such energy is imparted to a slide actuator connected to the cam action driver so as to operate the same to effect the desired positive, mechanical withdrawal of the breach block. Most desirably, the mechanism is arranged to provide a delay between the firing of the projectile and the time the block is withdrawn to enable the gas pressure within the barrel to dissipate before the block is removed to prevent "blow back" of the gases into the operating mechanisms of the firearm. The automatic action of the invention accomplishes these functions in a simple manner utilizing a minimum of moving parts.

The invention includes other features and advantages which will be discussed or will become apparent from the following more detailed description of a preferred embodiment.

DETAILED DESCRIPTION OF THE PREFERRED EMBODIMENT

Figure 1:
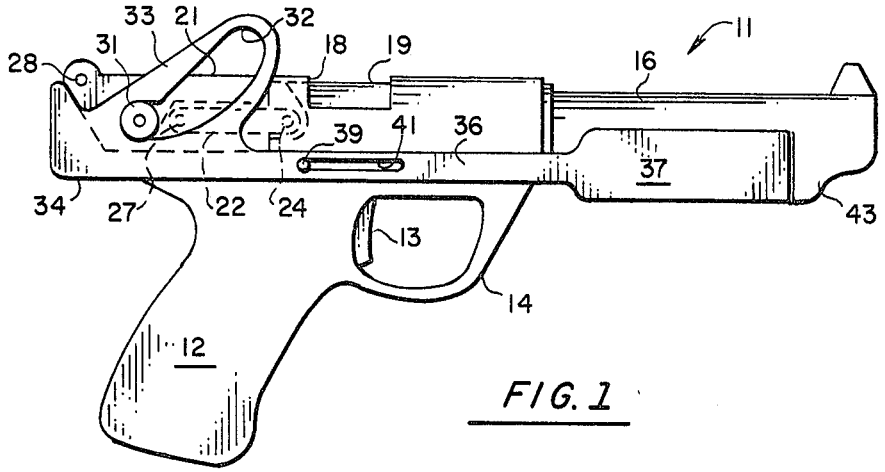
FIG. 1 is a side elevation view of a pistol incorporating a preferred embodiment of the automatic breach block action of the invention.

With reference to the drawing, a pistol incorporating the invention is generally referred to by the reference numeral 11. Such pistol includes the usual pistol grip 12, trigger 13, and trigger guard 14. A conventional fixed barrel 16 having a firing bore 17 forwardly of a breach 18 is also part of the structure.

A breach block 19 is also included for closing the firearm chamber, i.e., the rear end of the barrel into which a charge is placed. When it is in its chamber closing position, block 19 acts to prevent any appreciable escape of gases when a bullet is fired. Although not illustrated since it is conventional and not related to the instant invention, it will be appreciated that the pistol 11 includes the usual firing mechanism which translates depression of the trigger 13 into firing of any charge loaded into the chamber.

Figure 4:
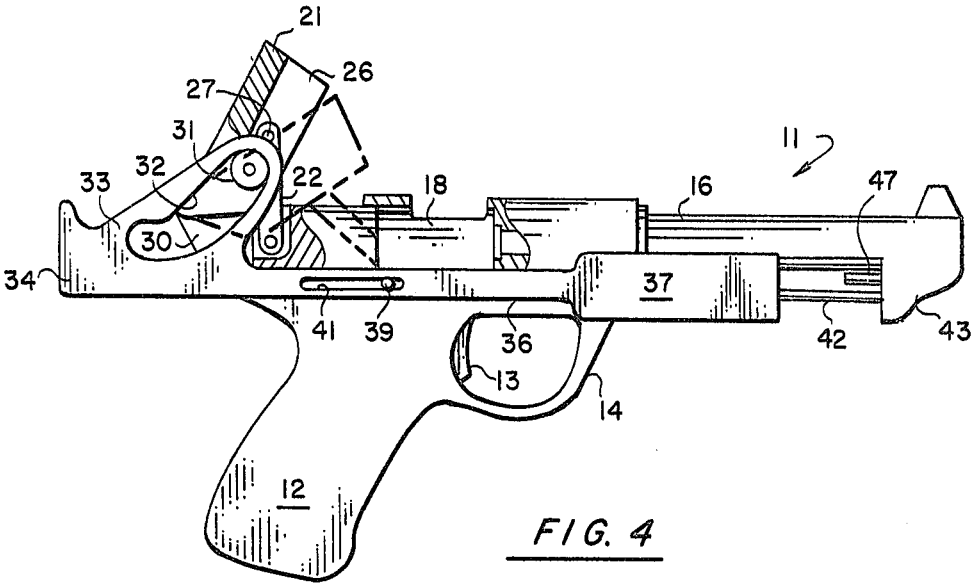
FIG. 4 is another broken-away, side elevation view of the pistol of FIG. 1 illustrating the relationship of the parts when the breach block is fully withdrawn, an intermediate position of the toggle link and the cam follower being indicated in phantom.

As mentioned previously, the invention relates to the manner in which the block 19 is automatically withdrawn on the firing of a bullet from its position closing the chamber in order to permit ejection of the spent cartridge and feeding into the chamber of a new round. To this end, an under-center locking toggle linkage made up of a pair of links 21 and 22 connect block 19 with a stationary part of the pistol 11. More particularly, the rear end of the block 19 is recessed at 23 to define a cavity within which the front end of the link 22 is pivotally connected to the block via a pin 24. When the action is in the position shown in FIG. 1, the toggle link 21 provides a continuation of the outer configuration of the barrel 16 to the rear of the pistol. Such link includes a central cavity 26 which is open at its front end and bottom side and into which link 22 projects. The rear end of link 22 is pivotally secured via a pin 27 within such cavity to link 21. Link 21, in turn, is pivotally secured by a pin 28 to an upstanding ear 30 (FIGS. 4 and 5) at the rear end of the pistol.

Figure 2:
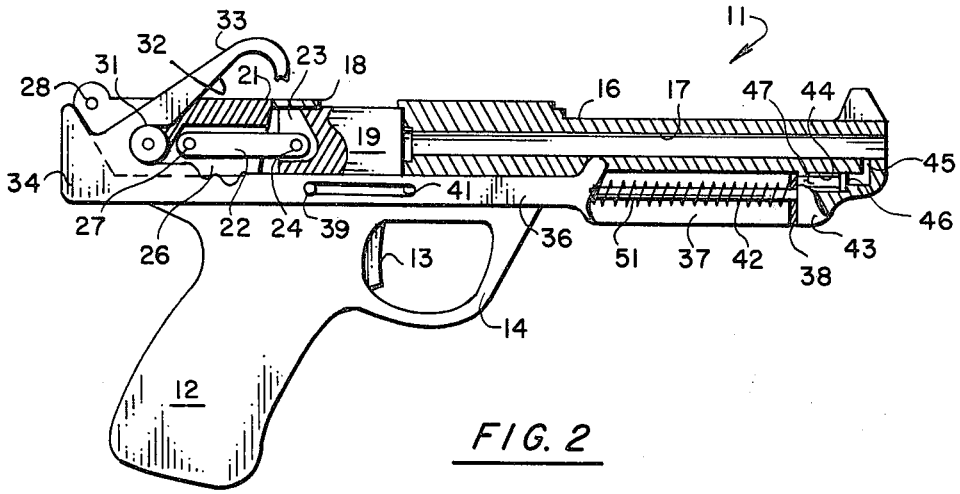
FIG. 2 is another side elevation of the pistol of FIG. 1, with parts broken away and sectioned to illustrate its construction.

It will be recognized that with this construction, the toggle linkage will provide positive locking of the breach block 19 closing the pistol chamber while still permitting simple withdrawal of such breach block to permit reloading. That is, when the breach block 19 is in the chamber closing position illustrated in FIGS. 1 and 2, the axis of pivot pin 27 is positioned below a straight line extending between the axes of pins 18 and 24. Thus, pressure against the breach block urging the same rearwardly will not cause the pin 27 to move upward and permit the toggle linkage to collapse. Downward movement of such pin is prevented by the obstruction to such movement provided by the remainder of the pistol. However, once the axis of pin 27 is raised above a line extending between the axes of pins 24 and 28, little pressure is required to move the breach block rearwardly, assuming, of course, freely pivotal link connections.

As mentioned previously, prior automatic breach actions utilizing beyond-center locking toggle linkages have taken advantage of the little pressure required to move the breach block rearwardly by relying on the gas pressure of an exploded round to provide such movement. The difficulty with such arrangements, though, is that "blow-back" gases are then permitted to enter the intricate operating mechanisms of the firearm and build up to clog the same. Moreover, this utilization of a portion of the gas pressure to move the breach block reduces the force available to propel the projectile, albeit by a small amount. The present invention eliminates reliance on blow-back gases and its attendant problems, by providing a positive mechanical drive for withdrawing the breach block. While the energy for the drive is obtained from the pressure generated by an exploded round, such energy is not extracted from the gas until the projectile has essentially received the full propelling force it will receive while in the barrel of the firearm.

The positive mechanical driving mechanism is provided by a cam and cam follower driver combination, made up of a cam in the form of a pin 31 mounted at a fixed position on link 21 and riding within a cam slot 32 provided in a flange 33 which projects upwardly from a slide actuator 34. Actuator 34 is mounted on the firearm for forward and rearward sliding movement. In this connection, actuator 34 includes a pair of arms 36 (only one of which is shown) projecting forwardly of the firearm on opposite sides of the grip 12 above trigger guard 14. Each of such arms includes a widened portion 37 adjacent its forward end, the forward ends of such arms being connected to one another via a transverse end wall 38.

The path of the actuator in its sliding movement is limited by two pins 39 which project from opposite sides of the firearm into corresponding elongated slots 41 in the actuator arms 36. The path of actuator movement is also controlled by an elongated rod 42 connected parallel to the barrel 16 between a downwardly projecting boss 43 at the forward end of the firearm and that portion of the firearm immediately above guard 14. As can be seen from FIG. 2, actuator end wall 38 includes an aperture through which the rod 42 projects so that the actuator will ride on such rod on moving forwardly and rearwardly.

As will be described in more detail hereinafter, upon sliding movement of the actuator rearwardly and forwardly of the remainder of the firearm, it will cause coaction between the camming surfaces of the cam pin 31 and cam slot 32 not only to "break" the lock provided by the toggle, but also to drive the breach block both into an open position to permit ejection of a spent cartridge and back into a closed position after a new round is loaded into the chamber. Actuator 34 is driven by the gas pressure of an exploded cartridge after such pressure has essentially driven the projectile from the barrel 17. To this end, the boss 43 at the front end of the barrel 16 includes a gas piston chamber 44 which has its forward end communicated via a channel 45 with the front of the barrel bore 17 adjacent its discharge end. A piston 46 within the chamber 43 to be driven by such gas pressure has an impulse rod 47 extending rearwardly of the same into engagement with the transverse wall 38 of the slide actuator. It will be apparent from this construction that when the gas pressure generated in the bore on the explosion of a cartridge within the chamber reaches the passage 44, i.e., after the projectile has passed such passage, such pressure will drive piston 46 and, hence, impulse rod 47 rearwardly. Because the free end of rod 47 engages the transverse wall 38 of slide 34, the slide actuator will be correspondingly urged rearwardly. In fact, the piston propulsion unit is engineered not only to initiate sliding movement of the actuator, but also to impart thereto sufficient momentum to cause operation of the cam and cam follower driver to both break the toggle lock and drive the linkage to withdraw the breach block from the firing chamber.

FIGS. 3–6 illustrate the various stages of operation of the automatic breach block action of the invention. The first round in the magazine of the pistol can be inserted into the chamber merely by manually sliding the actuator 34 rearwardly to open the breach and permit the feeding mechanism to insert the round into the chamber. The mechanism of the invention will then react to the firing of each round by breaking the toggle lock and withdrawing the breach to permit the cartridge ejection and round feeding mechanism to reload the chamber.

Figure 3:
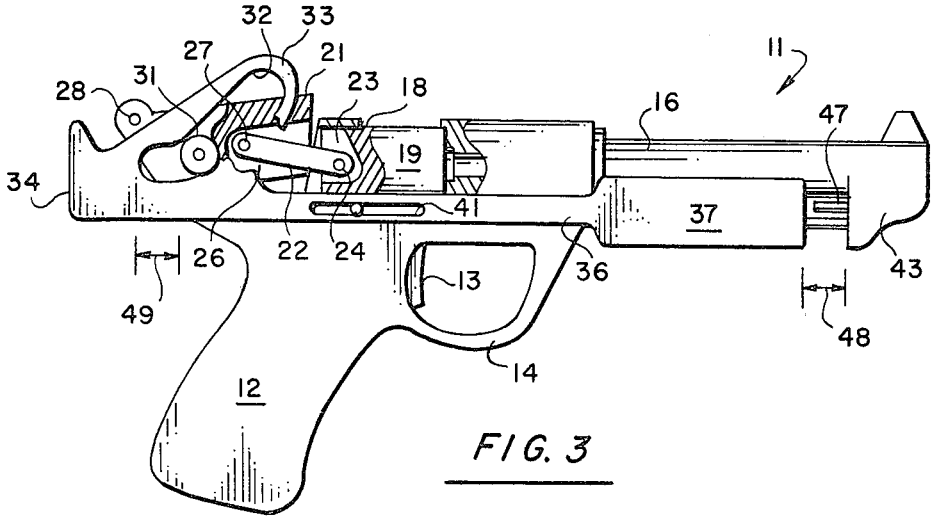
FIG. 3 is a broken-away, side elevation view of the pistol of FIG. 1, showing the relationship of the parts immediately after the toggle lock is broken.

FIG. 3 illustrates the relationship of the parts as the toggle lock is broken. As illustrated, the slide actuator 34 has moved rearwardly a distance denoted by the margin lines and arrow 48. It should be noted that during this initial travel of the actuator the toggle lock was not broken. This circumstance is caused by the fact that the cam slot 32 includes at its rear end a section having a length, denoted by the margin lines and arrow 49 in FIG. 3, in which its driving surface is generally parallel to the direction of travel of the slide actuator. Thus, a delay is provided between the firing of a projectile and the time the lock of the toggle is broken to enable movement of the breach block. The duration of this delay is selected to allow the gas pressure against the block associated with the firing to be substantially dissipated before such lock is broken. The result is that the breach block remains in position to react against the pressure during the full time the pressure is propelling the fired projectile, and when the breach block is withdrawn there is no significant gas blow-back to clog the firearm mechanism or cause firearm user discomfort.

After the toggle link is broken, the toggle linkage will be driven with positive camming action to withdraw the breach block from the chamber. More particularly, with reference to FIG. 4, the pin 31 will be forced upwardly as the slide actuator moves to the rear in view of the engagement of such pin with the lower edge of the cam slot 32. It is to be noted that, as shown in the drawings, the coacting cam surfaces of the pin and slot are shaped to initiate movement of the toggle linkage with relatively slow acceleration and then cause greater acceleration of such movement to withdraw the breach block fully. Moreover, they are shaped to provide a generally continuously changing acceleration between initiation of movement of the linkage and withdrawal of the breach block. In more detail, the peripheral surface of pin 31, i.e. its camming surface, defines a circular cylinder, and the lower edge (lower camming surface) of the cam slot is convexly curved with that section at its rear end responsible for the delay merging smoothly into the remainder of it. This particular relationship of the coacting cam surface shapes results in relatively "smooth" acceleration of the linkage to lessen the shock which otherwise would be imparted to such linkage by movement of the slide actuator. An intermediate position of such withdrawal is indicated in phantom in FIG. 4. The position of the mechanism when the camming action has fully withdrawn the breach block is illustrated in solid lines. Once the breach block is so withdrawn, the usual cartridge ejection and round feeding mechanisms come into play to reload the chamber.

The cam and cam follower driver is adapted also to drive the linkage with positive camming action to insert the block back into position closing the chamber and lock the same with beyond-center locking. That is, the upper edge of the cam slot 32 will engage pin 31 during return of the actuator to its initial position to positively drive the toggle link and, hence, the breach block back into the breach closing position.

Return means are included for returning the slide and, hence, actuate the cam driver to drive the linkage automatically after the block is withdrawn from the chamber. That is, a compression spring 51 coaxially surrounds rod 42 and extends between the plate 38 of the slide actuator and the point of connection of such rod to the firearm. Thus, spring 51 will be compressed by the actuator moving rearwardly. The result is that kinetic energy will be stored therein which, after the slide actuator is moved to its rearward limit, will urge the same forwardly.

Figure 5:
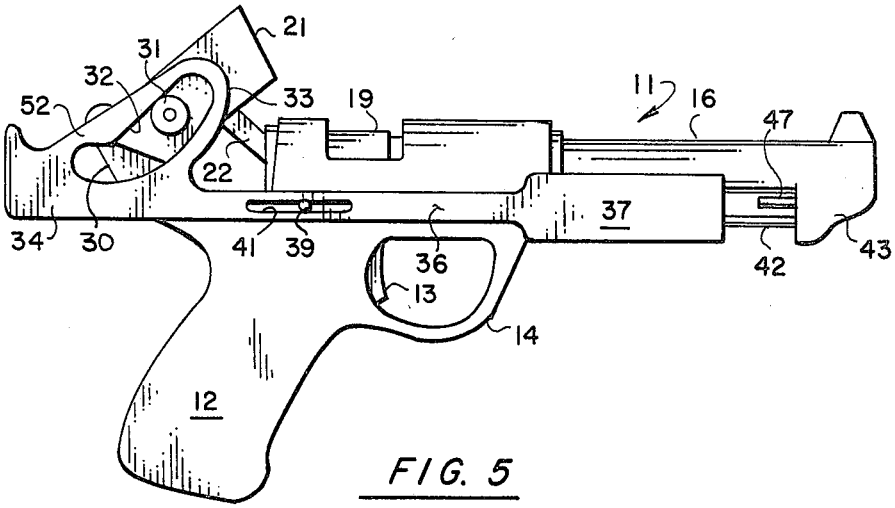
FIG. 5 is a side elevation view illustrating the relationship of the parts when the cam driver is returning the breach block to its closed position.
Figure 6:
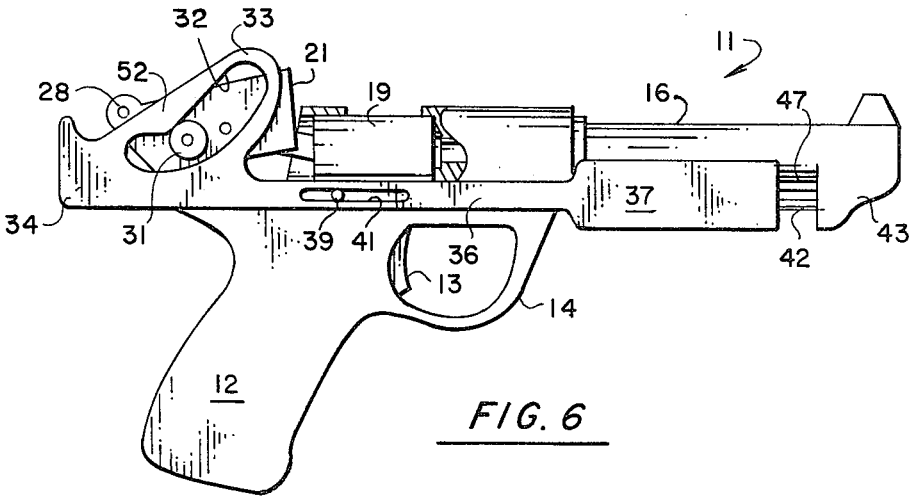
FIG. 6 is a broken away side elevation view showing the relationship of the parts immediately prior to the time the cam driver again causes the beyond-center toggle to lock the breach block into its chamber closing position.

FIGS. 5 and 6 illustrate the relationship of the parts during forward movement of the actuator. With reference to FIG. 5, it will be noted that cam pin 31 engages the upper edge of the slot 32 during such movement, with the result that the block is driven with positive camming action into a position closing the chamber. FIG. 6 illustrates the closing action immediately prior to the time the toggle linkage is again locked and the mechanism returned to the state illustrated in FIG. 1. As can be seen from such figure, the toggle locking action is caused by passage of the cam pin 31 over a cam ear 52. The slide actuator will then be moved by the spring 51 to its original position. That is, the cam pin will then move along that portion of the cam slot responsible for the previously discussed delay between the time a cartridge is exploded and the breach block is withdrawn.

Although the invention has been described in connection with a preferred embodiment thereof, it will be appreciated by those skilled in the art that various changes and modifications can be made without departing from its spirit. For example, cam pin 31 could be simply replaced by a cam roller. It is therefore intended that the coverage afforded applicant be limited only by the scope of the invention defined by the claims and their equivalent language. In this connection, the term "beyond-center" locking when used with reference to the toggle linkage is meant to encompass both over-center and under-center locking action.

I claim:

1. In an automatic breach block action for a firearm having a beyond-center locking toggle linkage operatively connected to said breach block to lock the same with beyond-center locking into a position closing the chamber of said firearm for projectile firing, the improvement comprising a cam and cam follower driver for said toggle linkage connecting the same to the remainder of said firearm and responsive to the firing of a projectile by breaking the toggle lock and then driving said linkage mechanically with positive camming action caused by coacting cam surfaces of said driver to withdraw said block from said chamber for insertion of another projectile therein, the coacting cam surfaces of said driver being shaped to initiate movement of said linkage with relatively slow acceleration and then cause greater acceleration of said movement to withdraw said breach block fully.

2. An automatic breach block action for a firearm according to claim 1 wherein said coacting cam surfaces are shaped to provide a generally continuously changing acceleration between said initiation of movement of said toggle linkage and withdrawal of said breach block.

3. An automatic breach block action for a firearm according to claim 1 wherein said cam and cam follower driver comprises a pin riding within a cam slot; said pin is fixedly connected to one of said toggle linkage and the remainder of said firearm, and said slot is provided in the other of said toggle linkage and said remainder of said firearm; and said pin defines a circular cylindrical camming surface, and said slot includes a convexly curved camming surface upon which said camming surface of said pin rides to provide said continuously changing acceleration.

4. An automatic breach block action for a firearm according to claim 1 wherein said cam and cam follower driver is adapted also to drive said toggle linkage mechanically with positive camming action to insert said block into position closing said chamber and lock the same into such position with beyond-center locking; return means are included for actuating said driver to so drive said linkage automatically after said block is withdrawn from said chamber; and said cam and cam follower driver provides a delay until the pressure against said block associated with said firing is substantially dissipated by providing cam movement immediately after actuation of the same which does not break said toggle lock.

5. An automatic breach block action for a firearm according to claim 1 wherein said firearm is a pistol which includes a slide actuator operatively connected to said cam and cam follower driver to operate the same to break said toggle lock and drive said toggle linkage upon a selected sliding movement of said actuator; and wherein said slide actuator is operatively communicated with the barrel of said pistol to respond to pressure therein caused by the firing of a projectile to initiate said selected sliding movement with sufficient momentum to cause said cam and cam follower driver to both break said toggle lock and drive said linkage to withdraw said block from said chamber.

6. An automatic breach block action for a firearm according to claim 5 wherein said operative communication of said slide actuator with said barrel is provided by a piston in a chamber which communicates with said barrel to drive said piston into engagement with said slide actuator and urge the latter into said selected sliding movement.

* * * * *